United States Patent [19]

Gamm

[11] Patent Number: 4,638,579

[45] Date of Patent: Jan. 27, 1987

[54] POCKETED ATHLETIC SHOE

[75] Inventor: Robert J. Gamm, St. Louis, Mo.

[73] Assignee: Kangaroos U.S.A., Inc., Chesterfield, Mo.

[21] Appl. No.: 802,935

[22] Filed: Nov. 27, 1985

Related U.S. Application Data

[60] Continuation of Ser. No. 612,992, May 21, 1984, abandoned, which is a continuation of Ser. No. 314,134, Oct. 23, 1981, abandoned, which is a continuation-in-part of Ser. No. 231,251, Feb. 3, 1981, Pat. No. 4,384,414, which is a division of Ser. No. 107,092, Dec. 26, 1979, Pat. No. 4,296,559.

[51] Int. Cl.[4] ..... A43B 23/00; A43B 5/00

[52] U.S. Cl. ..... 36/136; 36/114; 2/247; 2/DIG. 6

[58] Field of Search ..... 36/136, 132, 50, 114, 36/129; 2/247-253

[56] References Cited

U.S. PATENT DOCUMENTS

| | | | |
|---|---|---|---|
| D. 110,163 | 6/1938 | Andrews . | |
| D. 116,598 | 9/1939 | Pick . | |
| D. 130,845 | 12/1941 | Pick . | |
| D. 131,932 | 4/1942 | Atkins . | |
| D. 143,391 | 1/1946 | Barlow . | |
| D. 143,392 | 1/1946 | Barlow . | |
| D. 148,519 | 2/1948 | Campagna . | |
| D. 158,953 | 6/1950 | Gillis . | |
| D. 188,037 | 5/1960 | Dassler . | |
| D. 227,822 | 7/1973 | Askew . | |
| D. 228,267 | 9/1973 | Powers . | |
| D. 229,251 | 11/1973 | Askew . | |
| D. 229,900 | 1/1974 | Powers . | |
| D. 241,383 | 9/1976 | Dolinsky . | |
| D. 244,726 | 6/1977 | Katz . | |
| D. 247,932 | 5/1978 | Katz . | |
| D. 248,192 | 6/1978 | Stevenson . | |
| D. 250,617 | 12/1978 | Noches . | |
| D. 253,498 | 11/1979 | Katz . | |
| D. 255,956 | 7/1980 | Hirsch . | |
| D. 258,548 | 3/1981 | Famolare, Jr. . | |
| D. 258,772 | 4,1981 | Norton . | |
| D. 261,695 | 11/1981 | Gamm . | |
| D. 261,823 | 11/1981 | Gamm . | |
| 262,594 | 8/1882 | How . | |
| D. 271,157 | 11/1983 | Gamm . | |
| 294,020 | 2/1884 | Eisendrath . | |
| 317,451 | 5/1885 | Frey . | |
| 375,331 | 12/1887 | Berkey . | |
| 461,961 | 10/1891 | Neuberger . | |
| 601,192 | 3/1898 | Woodside . | |
| 654,388 | 7/1900 | Diemer | 36/136 |
| 746,338 | 12/1903 | Keen . | |
| 1,100,758 | 6/1914 | McAuslin . | |
| 1,128,941 | 2/1915 | Brown . | |
| 1,176,572 | 3/1916 | Lassig . | |
| 1,213,036 | 1/1917 | Taylor . | |
| 1,229,940 | 6/1917 | Gomes . | |

List Continued on next page.

*Primary Examiner*—James Kee Chi

*Attorney, Agent, or Firm*—Paul M. Denk

[57] ABSTRACT

In an athletic shoe having a pocket, generally disposed laterally and mounted upon the quarter portion of the shoe, the pocket comprises a liner of material, or a pair of the same, each stitched or otherwise fastened to the side of the shoe, so that various edges of the pocket are confiningly affixed to the shoe, while the bottom edge of the pocket may be stitched to the quarter panel upwardly of the sole, or the same may be secured with the shoe through the effort of the stitching that holds the sole shank to the shoe quarter portion. Proximate the rearward edge of the pocket, in the various embodiments, there is provided a slot opening, which may be securable through the connection of a zipper, so that access may be attained into the pocket for admitting personal items therein. In other embodiments the slot, or zippered slot, may be located diagonally or angulated; but in any event, all embodiments of the slotted pocket may also be covered by a covering flap that attaches either adjacent the rearward edge of the formed pocket, or along the eyestay of the athletic shoe.

4 Claims, 9 Drawing Figures

U.S. PATENT DOCUMENTS

| | | | |
|---|---|---|---|
| 1,289,341 | 12/1918 | Wirsching . | |
| 1,342,149 | 6/1920 | Avis . | |
| 1,502,919 | 7/1924 | Seib . | |
| 1,561,088 | 11/1925 | Ladue . | |
| 1,637,565 | 8/1927 | Gordon . | |
| 1,763,997 | 6/1930 | Williams . | |
| 1,832,866 | 11/1931 | Johnson . | |
| 1,869,652 | 8/1932 | Baker . | |
| 1,870,751 | 8/1932 | Reach . | |
| 1,889,734 | 3/1932 | Stevenson . | |
| 1,905,235 | 4/1933 | Mandeleret . | |
| 1,952,409 | 3/1934 | Berg . | |
| 1,952,628 | 3/1934 | MacDonald . | |
| 1,986,580 | 1/1935 | Johnson . | |
| 1,990,970 | 2/1935 | Wood . | |
| 2,013,847 | 9/1935 | Gephardt . | |
| 2,037,683 | 4/1936 | Hasenberg . | |
| 2,065,693 | 12/1936 | Haserodt . | |
| 2,095,869 | 10/1937 | Hermson . | |
| 2,154,510 | 4/1939 | King . | |
| 2,260,138 | 10/1941 | Feinberg . | |
| 2,302,596 | 11/1942 | Bigio . | |
| 2,321,360 | 6/1943 | Chambers . | |
| 2,421,796 | 6/1947 | Maling . | |
| 2,442,415 | 6/1948 | Kubobcik . | |
| 2,444,640 | 7/1948 | Epstein . | |
| 2,492,862 | 12/1949 | Harvey . | |
| 2,527,224 | 10/1950 | Landy . | |
| 2,539,761 | 1/1951 | Whitman . | |
| 2,544,840 | 3/1951 | Kowatsch . | |
| 2,593,711 | 4/1952 | Weatherly . | |
| 2,615,168 | 10/1952 | Tannenbaum . | |
| 2,619,744 | 12/1952 | Mattes . | |
| 2,624,881 | 1/1953 | Lee . | |
| 2,662,677 | 12/1953 | Perry . | |
| 2,686,376 | 4/1954 | Burkholz . | |
| 2,712,700 | 7/1955 | Solomon | 36/136 |
| 2,801,477 | 6/1957 | Adams et al. | 36/136 |
| 2,806,300 | 9/1957 | Morgan, Jr. . | |
| 2,840,825 | 7/1958 | Garrido . | |
| 2,908,982 | 10/1959 | Corley . | |
| 2,919,443 | 1/1960 | Kashiyama . | |
| 2,925,672 | 2/1960 | Trovato . | |
| 3,018,570 | 1/1962 | Bliese | 36/136 |
| 3,046,563 | 7/1962 | Coleman . | |
| 3,114,982 | 12/1963 | McGowan . | |
| 3,138,880 | 6/1964 | Kunzli . | |
| 3,193,842 | 7/1965 | Bell . | |
| 3,206,765 | 9/1965 | Sherman . | |
| 3,259,160 | 7/1966 | Penna . | |
| 3,290,801 | 12/1966 | Bente . | |
| 3,306,610 | 2/1967 | Biggs, Jr. . | |
| 3,334,898 | 8/1967 | McCrory . | |
| 3,459,191 | 8/1969 | Barg . | |
| 3,518,898 | 7/1970 | Barg . | |
| 3,537,108 | 11/1970 | Daniels . | |
| 3,543,420 | 12/1970 | Dassler . | |
| 3,559,310 | 2/1971 | Kiela . | |
| 3,565,081 | 2/1971 | Barg . | |
| 3,574,958 | 4/1971 | Martuo . | |
| 3,631,613 | 1/1972 | Brettell . | |
| 3,703,775 | 11/1972 | Gatti . | |
| 3,835,474 | 9/1974 | Williamson . | |
| 3,937,373 | 2/1976 | Artz . | |
| 4,065,861 | 1/1978 | Pelfrey . | |
| 4,067,124 | 1/1978 | Rys-Sikora . | |
| 4,073,075 | 2/1978 | O'Brien . | |
| 4,114,297 | 9/1978 | Famolare . | |
| 4,130,950 | 12/1978 | Bazzle . | |
| 4,145,762 | 3/1979 | Wallach . | |
| 4,245,408 | 1/1981 | Larsen . | |
| 4,280,287 | 7/1981 | Gulbransen | 36/136 |
| 4,282,657 | 8/1981 | Antonious . | |
| 4,282,912 | 8/1981 | Brown . | |
| 4,296,559 | 10/1981 | Gamm . | |
| 4,366,634 | 1/1983 | Giese . | |
| 4,384,414 | 5/1983 | Gamm . | |

FOREIGN PATENT DOCUMENTS

| | | |
|---|---|---|
| 82020 | 9/1980 | Australia . |
| 581825 | 8/1959 | Canada . |
| 48459 | 7/1981 | Canada . |
| 48460 | 7/1981 | Canada . |
| 48461 | 7/1981 | Canada . |
| 1944609 | 3/1971 | Fed. Rep. of Germany . |
| MR16756 | 5/1980 | Fed. Rep. of Germany . |
| MR16757 | 5/1980 | Fed. Rep. of Germany . |
| GM8016130 | 6/1980 | Fed. Rep. of Germany . |
| 488708 | 2/1917 | France . |
| 569694 | 4/1924 | France . |
| 967975 | 11/1950 | France . |
| 1447044 | 6/1966 | France . |
| 1484987 | 6/1967 | France . |
| 802601 | 8/1980 | France . |
| 2472352 | 7/1981 | France . |
| 49-13142 | 2/1974 | Japan . |
| 32694 | 2/1981 | Rep. of Korea . |
| 32695 | 2/1981 | Rep. of Korea . |
| 0761002 | 9/1980 | Netherlands . |
| 97933 | 5/1981 | Spain . |
| 254132 | 6/1981 | Spain . |
| 13054 | 12/1980 | Taiwan . |
| 23122 | of 1913 | United Kingdom . |
| 302862 | 12/1928 | United Kingdom . |
| 302520 | 1/1929 | United Kingdom . |
| 479087 | 2/1938 | United Kingdom . |
| 1177531 | 1/1970 | United Kingdom . |
| 1225359 | 3/1971 | United Kingdom . |
| 1293925 | 10/1972 | United Kingdom . |
| 995442 | 12/1979 | United Kingdom . |
| 995443 | 12/1980 | United Kingdom . |
| 2067384 | 7/1981 | United Kingdom . |

OTHER PUBLICATIONS

Footwear News, 3-7-77, Dec, 4, 1978, p. 27, Jan. 10, 1977, p. 27, Mar. Apr. Jul. Aug. Sep. Oct. Nov. 1976, Apr. Mar. May Sep. 1977, Apr. May. Jul. Nov. 1978.

Edison Brothers Catalogue 7-24-78.

B. Rosenberg & Sons, Inc. Fall 1976, Winter, 1976.

Runner's World—Aug., 1978, pp. 30, 31, Jun. Jul. 1976, Feb. May. Oct. Nov. 1978, Jan. 1979.

Specs International Inc. 2-1-7-82.

Sears Roebuck 1941.

Diversified Footwear 1978.

Sporting Goods Dealer, Oct. 1976, Apr. 1978.

Klickettes Fall Winter 1973.

Price List Fal 1973.

Kingswell Track Oct. 1976.

St. Louis Post Dispatch Oct. 1976, Mar. Apr. May Jun. Jul. 1977.

St. Louis Globe Democrat Oct. 1976.

POCKETED ATHLETIC SHOE

CROSS REFERENCE TO RELATED APPLICATIONS

This application is a continuation of the application having Ser. No. 612,992, filed on May 21, 1984, now abandoned, and which application is denominated as a continuation of the application having Ser. No. 314,134, filed on Oct. 23, 1981, and now abandoned, and which latter application is denominated as a continuation-in-part of the application having Ser. No. 231,251, filed on Feb. 3, 1981, and now U.S. Pat. No. 4,384,414, and which application is denominated as a division of the application having Ser. No. 107,092, filed on Dec. 26, 1979, and now U.S. Pat. No. 4,296,559.

BACKGROUND OF THE INVENTION

This invention relates generally to athletic shoes, and more particularly pertains to a formed pocket arranged laterally of the shoe and having utility for temporary storage of personal items during shoe usage, as when employed during jogging, or for other athletic events.

The safety of personal items has always been foremost of one's self interest. And, to assure ones protection of his possessions, various means were employed for assuring such safety particularly where some wealth was involved. For example, in the early U.S. patent to Diemer, U.S. Pat. No. 654,388, upon a shoe, a means for securing valuables concealingly within the calf portion of the shoe, and more specifically upon its internal portion that rests against the leg, was given consideration. Thus, the shown embodiment provided means for securing ones valuables, such as money, and in addition furnished concealment of the same in the event that one was personally accosted, as by thief. Various other forms of similar type pocket structures used in association particularly with boots are also shown in the earlier U.S. patents to Wirsching, U.S. Pat. No. 1,289,341, McAuslin, U.S. Pat. No. 1,100,758, in addition to the patent to Avis, U.S. Pat. No. 1,342,149.

More contemporary inventors have given thought to various types of structures for forming pocket means within shoes and boots, such as shown in the U.S. patent to Corley, U.S. Pat. No. 2,908,982. The concept of adding decorativeness to the shoe through the addition of a purse, or the like, as by attaching the same upon the frontal shoe upper, is shown in the U.S. patent to Bliese, U.S. Pat. No. 3,018,570, in addition to the U.S. patent Solomon, U.S. Pat. No. 2,712,700. Furthermore, the adding of holding means having some utility to the shoe, as by securing the same through its laces to the shoe, is shown in the golf tee holder as devised by Perry, in his U.S. Pat. No. 2,662,677.

Furthermore, the U.S. patent to Adams, et al., U.S. Pat. No. 2,801,477, discloses means for ornamental attachment to shoes, through the arrangement of edge materials to the shoe quarter and into which colored plaques may be slid for observance.

All of the foregoing embodiments have utility for holding some component or personal item, such as money, in a concealed fashion upon the wearer, while the current invention, to the contrary, intends to provide a pocket part that can be built structurally and integrally of the quarter part or portion of the shoe, so as to hold smaller personal items such as keys and money, while further incorporating in certain instances, the flap means that protectingly covers the pocket and further enhances the ability of the shoe to prevent untimely loss of such items.

It is, therefore, the principal object of this invention to provide a pocket part that is structurally built into the quarter portion of a shoe, and may incorporate closure means, such as a zipper, or covering flap, so as to assure that personal items such as keys and money will not be inadvertantly lost by the wearer, and particularly the jogger, during a running session.

Another object of this invention is to provide a pocket means that is integrally structured into the quarter portion of an athletic shoe and may incorporate a covering flap that assures retention of personal items within the formed pocket, while simultaneously enhancing the attractiveness of the shoe.

Still another object of the invention is to provide fastening means, in the nature of Velcro, or a snap clasp, or the like, that assures adherance of the covering flap upon and to the shoe pocket and to obviate its loosening or flapping as while the wearer participates in jogging, or other related sports that entail intensive running.

Still another object of this invention is to provide a shoe pocket, conveniently built into the structure of the shoe, and which incorporates an opening slot that is arranged generally extending from an upper to a lower edge of the formed pocket and into which personal items may be quickly inserted without necessitating further manipulation of the shoe or any of its other component parts.

Still another object of this invention is to provide a shoe pocket having a vertically arranged opening or slot provided therein and into which personal items may be inserted, or removed.

Yet another object of this invention is to provide a shoe pocket having an opening slot and which is arranged diagonally with respect to the formed pocket so as to allow the entrance or removal of personal items with respect thereto.

Another object of this invention is to provide a shoe pocket integrally formed into the structure of the shoe and which can be conveniently and promptly installed during a stage of shoe assembly.

These and other objects will become more apparent to those skilled in the art upon reviewing the summary of this invention, and upon undertaking a study of the description of its preferred embodiment, in view of the drawings.

SUMMARY OF THE INVETNION

This invention contemplates the formation of an athletic shoe, and more specifically one having a pocket part or portion structured into the shoe side or quarter part, this construction generally being formed through the addition of a layer of material to the shoe side, being stitched thereto along particular edges, usually the upper, lower, and frontal edges, and having a slotted opening formed either along the back edge of the formed pocket, or arranged angular therealong. In the embodiments, a zipper or other means for fastening or forming closure is arranged preferably in conjunction with the formed pocket slot and when opened, forms an entrance into the pocket part and into which the aforesaid type of personal items may be inserted. And, the zipper may then be closed to assure safe confinement of such items while the shoe is employed in usage, and subjected to rather impacting forces and movement. A flap may be provided for forming coverage upon the liner formed pocket, with the flap generally being stitched along and in proximity with the back edge of the said pocket, then being arranged in overlying relationship by folding the same forwardly over the underlying pocket slot, zipper closure, or other means provided for furnishing securement for the personal items enclosed within the said pocket. In addition, the closure flap may be stitched along the upper edge of the formed pocket, as along the eyestay for the athletic shoe, and then folded downwardly into an overlying relationship contiguously against the shoe pocket, and held thereto by means of some form of fastening means, such as Velcro, a snap fastener, or the like.

DESCRIPTION OF THE PREFERRED EMBODIMENT

Figure 1:
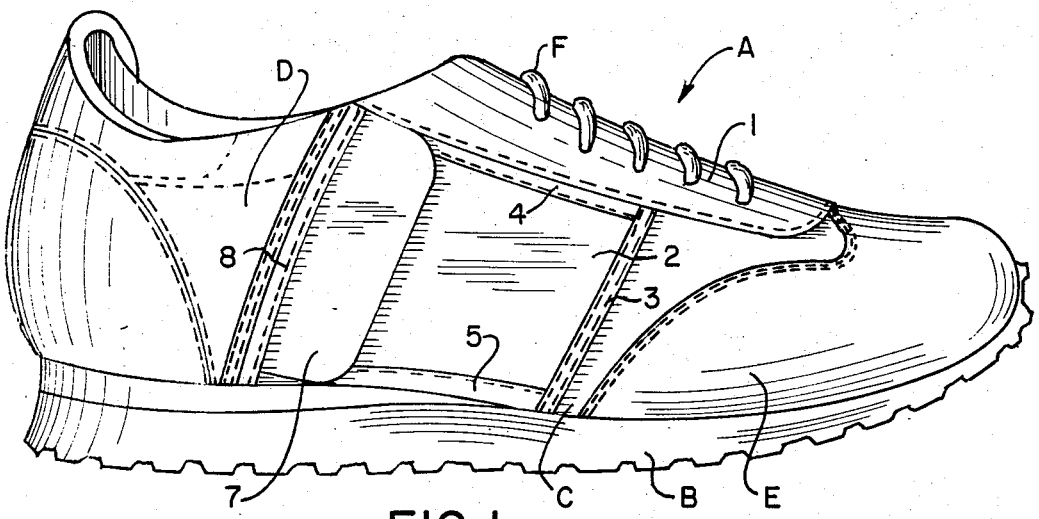
FIG. 1 provides a side view of a shoe pocket with rear edge flap, formed upon the quarter portion of an athletic shoe.
Figure 2:
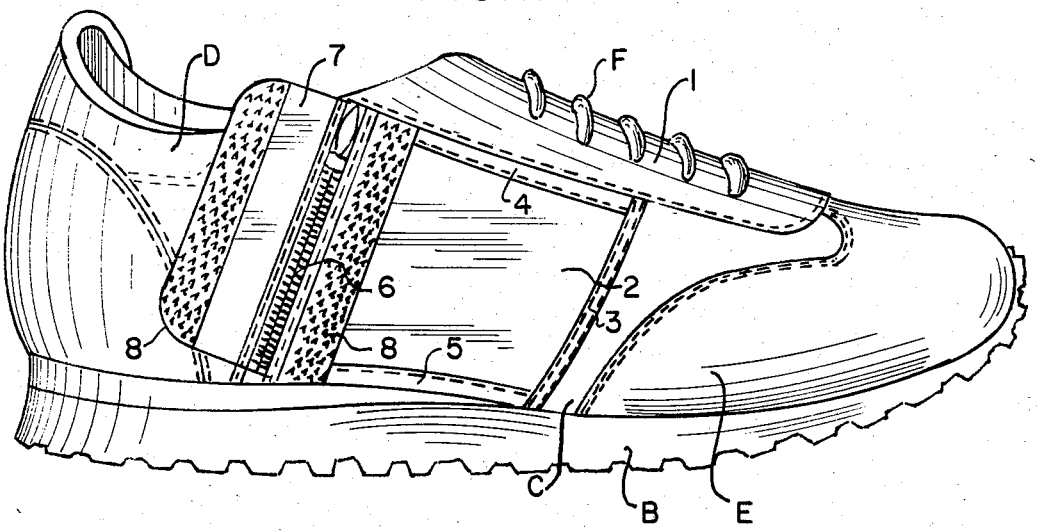
FIG. 2 furnishes a similar view to that shown in FIG. 1, with the closure flap being turned backwardly so as to disclose fully the pocket and its fastening means.
Figure 3:
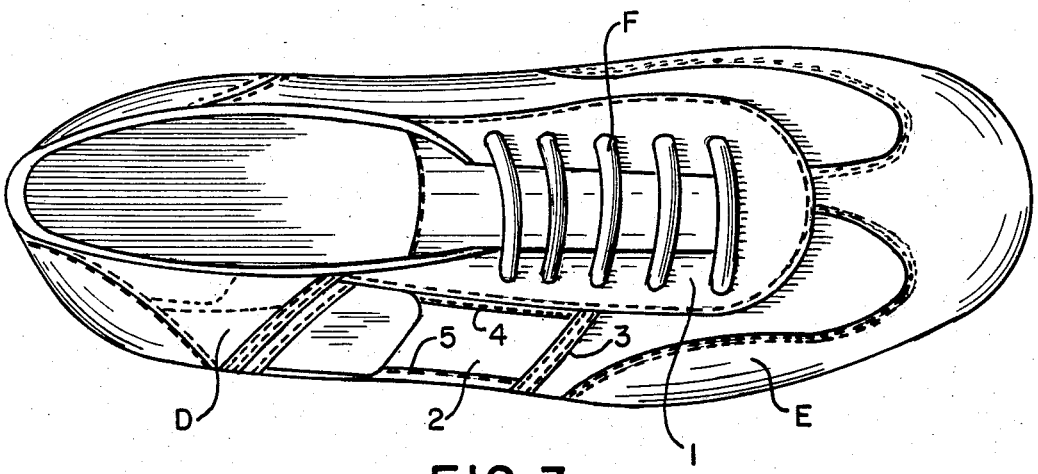
FIG. 3 provides a plan view of the shoe shown in FIG. 1.

In the drawings, and in particular FIGS. 1 through 3, there is shown in both the side, top, and flap opened views for the athletic shoe A which is of the usual construction having a sole portion B stitched at its shank C and to the shoe quarter D, its vamp E, and the shoe upper as normally constructed into the assembled shoe. In addition, an eyestay 1 is also stitched to the shoe quarter at its upper margin, and useful for securing the laces F that hold the emplaced shoe upon the foot. In this particular invention, a liner of material, as at 2, and comprising therein a singular or pair of liners, is also stitched along its reinforced front, upper and lower seams 3 through 5, respectively, and may also be held by means of that stitching which secures the eyestay in place; and perhaps, at its lower edge, the liner 2 may be turned under with the shoe quarter D, as shown, and be stitched along the shank for adherence with the sole B of the disclosed shoe. On the other hand, the stitchings 3 through 5 may be independent of the other means for securement of the above identified shoe parts together. But, in order to facilitate the usage of the formed pocket associated with the identified shoe, it is desirable that the pocket does extend from at least in proximity with the eyestay 1, and into that region near the shoe shank, in order that the pocket may have sufficient depth, in addition to the shown width, in order to accommodate the type of personal items as previously identified.

With the attachment of the pocket linings to the shoe quarter, or its sides, and with either a single or double lining being employed, the shoe pocket is thus formed and secured with the side of the shoe. Provided, preferably, at the region of the rear edge of the formed pocket, there is furnished a closure means, such as the zipper 6, as shown, and the zipper is provided through the outermost pocket lining, and forms closure for the slot formed along the rear heighth of the arranged pocket, and through which said slot, when its zipper is opened, provides for the insertion or removal of items from within the said structured pocket. In those instances where the pocket is formed of a single liner, the items would then be located between the said liner, forming the outer covering for the pocket, and the side of the constructed shoe. But, in those other instances where the shoe pocket is formed from a pair of linings, the space between the linings forms the desired pocket. This has already been fully identified and explained in my previous patent applications. By simply manipulating the zipper from the top to bottom, or vice versa, for providing for its opening, personal items such as keys or coins may be inserted into the pocket for safekeeping as during participation within an athletic event, such as while one is jogging and running. The pocket, in this formation, is adequate for providing safekeeping for such items, but the usual jogging paraphernalia, such as shorts, or a sweatsuit, which ordinarily do not contain pockets, and if they do, are likely to lead to a loss of coin or keys that may be kept within the same, particularly during the strenuous exercise encountered as during jogging.

To further add to the structure of the shown invention, a flap 7 may secure along the rear edge of the formed pocket, either to the edge of the pocket itself, or to the shoe quarter, and being stitched thereat by means of the stitching 8, and which flap may be conveniently folded over into contiguity against the formed shoe pocket, at least proximate its rearward location, so as to provide coverage upon the same and to insure the safety of any items contained within the pocket, and likewise, to provide coverage for any closure means, such as the zipper 6, as shown, thereat. In addition, providing a closure flap at this location assures a pleasing appearance for the shoe esthetics by covering the said closure means as explained. Such a flap is not totally essential to the shoe construction for assuring the proper operation and usage of its pocket, but it does add to the safekeeping of the pocketed items, and in addition, adds to the overall attractiveness of the shoe. In addition, fastening means, such as the Velcro 8A, being a hook and pike connecting means, or other fastening means, may be provided upon the outer edge of the inner surface of said closure flap 7, in addition to being provided in alignment upon the formed pocket 2, as can be seen, so that when the flap 7 is folded over into an overlying relationship upon the formed pocket, such fastening means conveniently holds the flap contiguous with the shoe, and assures its retentionship thereat so as to prevent its flapping, as when the athletic shoe is being used.

As previously explained, when the pocket 2 is formed from a single liner of material, then obviously that single liner forms the outer surface for the formed pocket, while the shoe side or quarter itself acts as the inner surface for the constructed pocket. The advantage for this particular feature is that the pocket may be constructed to that size which may almost coincide with the dimensions for the shoe quarter, and thereby provide a pocket that is of ample size, provided almost along the full heighth of the shoe side, and thereby adequately furnish room for holding a variety of personal items, such as the keys, coins, or the like, as previously explained.

Figure 4:
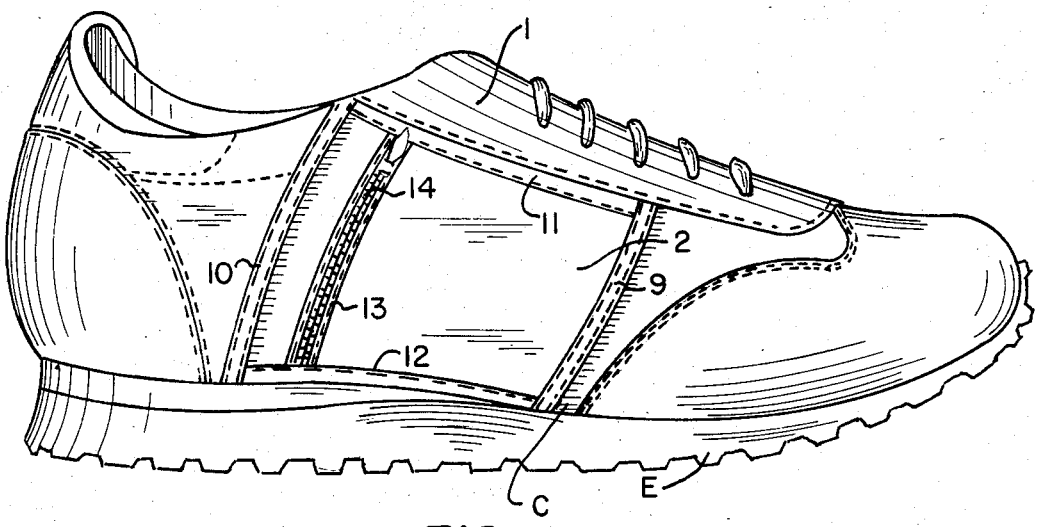
FIG. 4 discloses a side view of a modified shoe, similar to that shown in FIG. 1, but without any covering flap.
Figure 5:
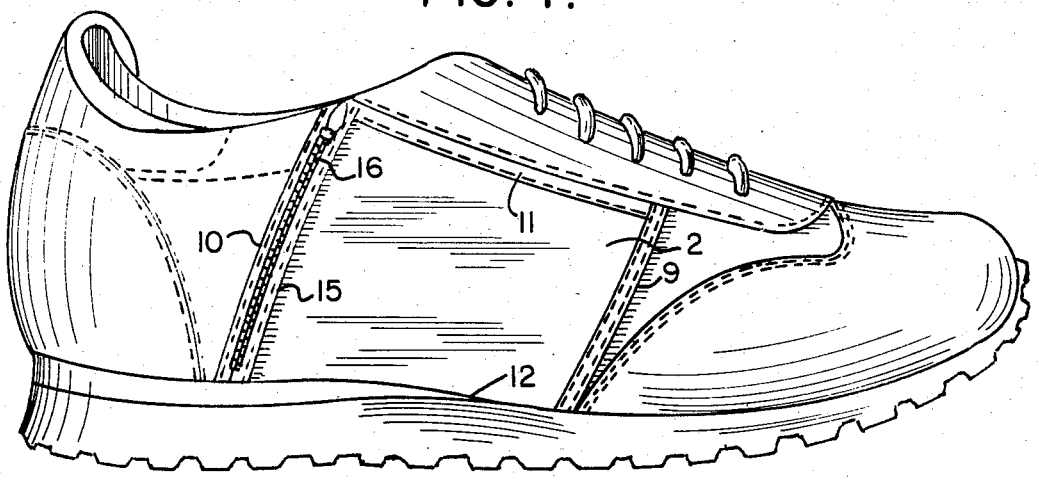
FIG. 5 provides a side view of a modified shoe to that shown in FIG. 1, with the closure flap being removed, and having the fastening means arranged proximate the rearward edge of the formed pocket.
Figure 6:
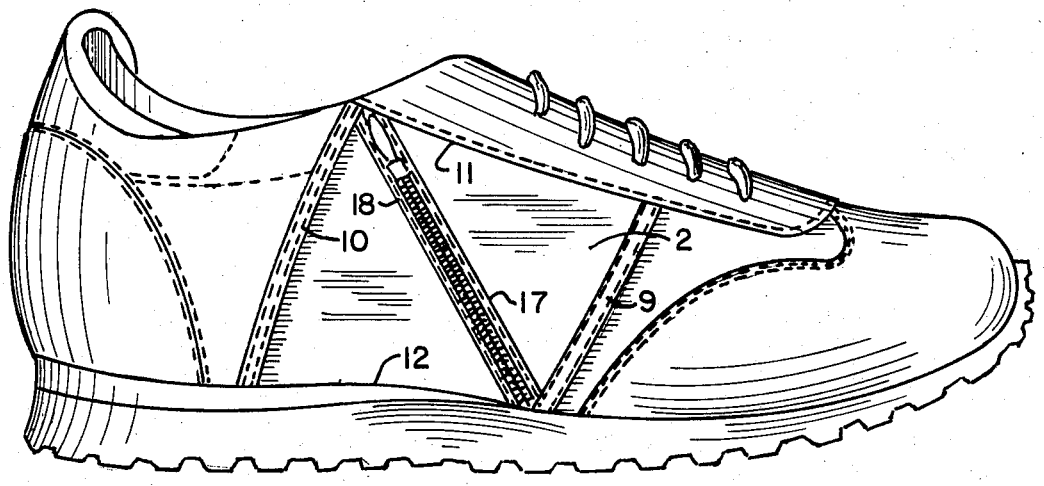
FIG. 6 provides a side view of a modified shoe pocket wherein the closure means is diagonally arranged along the formed pocket.

Variations in the formation of the shoe pocket are also contemplated for this invention, and as can be seen in FIGS. 4 through 6, the pocket 2 as formed may be stitched to the shoe quarter along its front edge 9, rear edge 10, upper edge 11, and the lower edge 12 as shown. As previously explained, the upper edge 11 may include the same stitching that holds the eyestay 1 in place within the integral construction of the shoe. In addition, the lower edge 12 may be stitched in conjunction with the shank portion C for the shoe and which holds the sole E to the shoe body. In this particular instance, the slot forming the opening within the formed pocket 2 extends approximately from its upper to lower edges of the formed pocket, as shown at 13, and includes the closure means, such as the zipper 14, arranged thereat, so that when the zipper is opened, personal items may be located within the formed pocket. The safety of their retention can be assured by simply closing the zipper 14 in the usual manner.

As can be seen in FIG. 5, the formed edges for the pocket are identical to those as previously explained, but that in this instance, the opening slot, as at 15, is formed adjacent and contiguous with the rear edge 10 of the formed pocket. The closure means or zipper 16 is provided thereat for the identical purposes as just previously explained.

As can also be seen in FIG. 6, the constructed pocket is once again very similar to that of the pocket as explained in FIGS. 4 and 5, but in this particular instance the pocket slot 17 is formed along an angle or at a diagonal, as shown, and has its closure means, such as the zipper 18, arranged in conjunction therewith so as to provide closure for this access slot. In this particular instance, providing an angulated slot along the pocket provides for the fullest degree of opening for the pocket, and the insertion of items therein, since the largest opening to be attained from a rectangular or parallelogram formed pocket is that which lies upon its diagonal or angular relationship.

Figure 9:
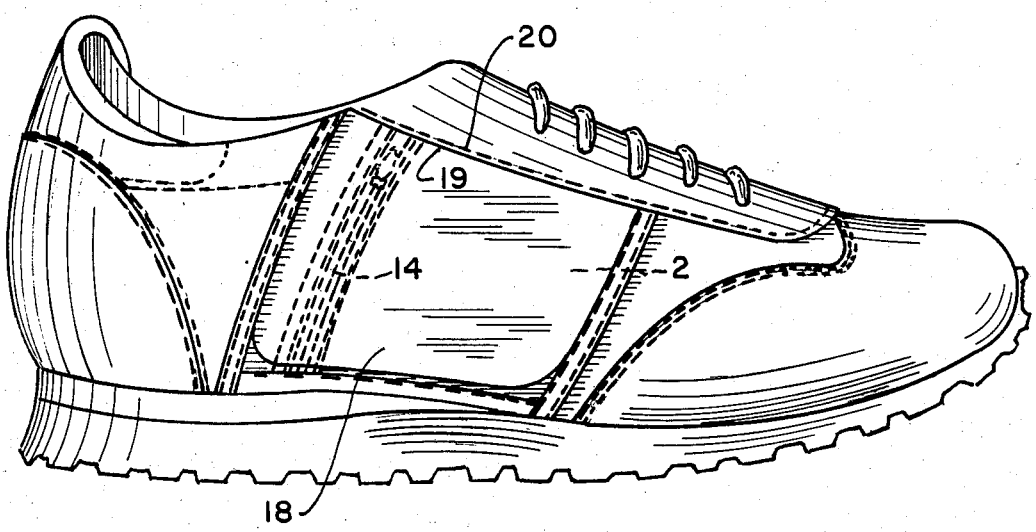
FIG. 9 furnishes a side view of a modified shoe pocket wherein its closure flap connects with the shoe along the eyestay adjacent the upper edge of the formed pocket and is arranged in overlying relationship in its folding downwardly upon the underlying shoe pocket.

As can also be seen in FIG. 9, the same type of shoe pocket 2, as described with respect to FIGS. 4 through 6, are shown, and in this particular instance being the formed pocket having the closure means 14 as shown in FIG. 4, but in this particular design a closure flap 18 is stitched at its upper edge, as at 19, by means of the upper edge pocket stitching, or the eyestay stitching, as at 20, to the shoe, and thereby provides an upwardly folding closure flap that is useful for providing full coverage for most of or the entire pocket after items have been located therein. Once again, and although it is not shown, Velcro or other forms of fastening means may be used for holding the closure flap securely upon the formed pocket.

Figure 7:
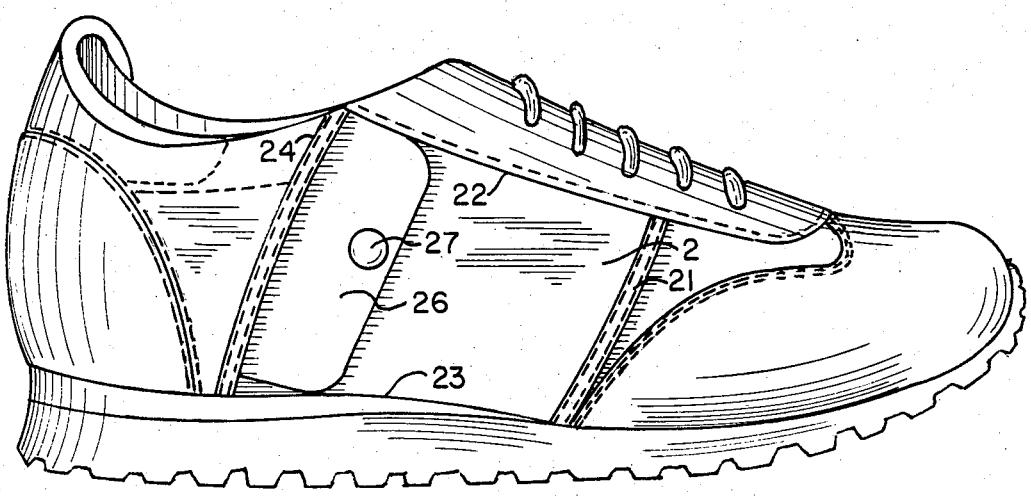
FIG. 7 provides a side view of a modified shoe pocket wherein its closure flap is adhered by means of a snap clasp to the formed pocket part.
Figure 8:
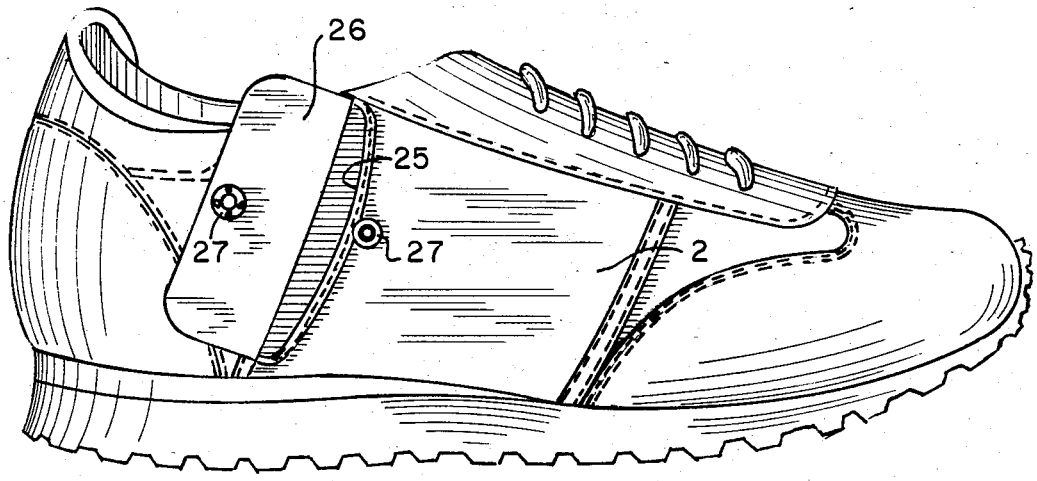
FIG. 8 provides a side view of the shoe shown in FIG. 7 and wherein its closure flap is folded rearwardly to disclose its opening pocket slot.

A further design for the pocketed athletic shoe is show in FIGS. 7 and 8. In this particular embodiment, the pocket 2 is once again stitched along its front edge 21, upper edge 22, lower edge 23, and rear edge 24 in the manner as previously explained. In this particular embodiment, the pocket slot, as at 25, is provided proximate the rear edge of the formed pocket 2, may be pulled open in the manner as shown in this FIG. 8, for the insertion of items therein. The closure flap 26 is also secured by means of stitching, or otherwise, proximate the rear edge of the formed pocket 2, and may be folded over and held in place by means of a fastening means, such as the snap clasp fastener 27, as shown, or perhaps through the use of Velcro, or the like. In any event, once the closure flap 26 is arranged into overlying relationship upon the shoe pocket, as shown in FIG. 7, personal items located within the pocket are secured therein for safekeeping even when the wearer may subject his shoe to excessive movement, as during jogging.

Variations or modifications in the shoe designs, or more specifically the pockets provided for these athletic shoe, may occur to those skilled in the art upon reviewing the subject matter of this invention. Any such changes if within the spirit of this invention, are intended to be encompassed within the scope of any claims to patent protection issuing upon this invention. The various descriptions set forth previously herein are done so for illustrative purposes only.

Having thus described the invention what is claimed and desired to be secured by Letters Patent is:

1. In a pocket for an athletic shoe and of the type incorporating a sole, quarter portions, counters, eyestay, and a vamp, all formed of flexible material, and securing together to form a structured athletic shoe, the quarter portions, counters, and vamp connecting with the shoe at its sole shank, and said shoe pocket designed to hold smaller sized personal items, such as keys, coins, or the like, as during jogging, comprising, said shoe having a quarter portion secured at the lower extent to the sole shank, a pocket being formed securing with at least one of the shoe quarter portions and being of substantial size so as to overlie a substantial portion of the underlying shoe quarter portion, said pocket being secured at its lower part by being turned under with said quarter portion for securement with the sole at its shank, said pocket also having upper, front, and back edges, with said pocket edges being stitched to the contiguous quarter portion, said upper pocket edge being arranged adjacent the shoe eyestay, and being affixed in adjacency therewith, said front pocket edge being arranged proximate the shoe vamp, and said back pocket edge being arranged proximate the shoe counter, a slot being provided within said pocket to allow access into the pocket interior for the deposit of the aforesaid type of items therein, there being ends for the formed pocket slot, and one end of said slot terminating adjacent the lower edge of the formed pocket, while the opposite end of the pocket slot terminating just proximate the upper edge of the formed pocket and in proximity with its connected eyestay, the disposed slot extending in adjacency upon the quarter portion overlying the shape of the foot of its wearer therein, and arranged just proximate the back edge of the formed pocket, zipper means provided upon the said shoe and within the region of and upon the opening of said pocket and disposed for providing closure for its formed slot, said pocket slot being disposed approximately in alignment with the said disposed back edge of the formed pocket, said zipper means being arranged aligned with the back edge of the formed pocket, and extending approximately from its eyestay to the sole shank of the athletic shoe, said zipper means being arranged aligned just slightly forwardly of the said rearward edge of the formed pocket.

2. The invention of claim 1 and including a cover flap, said flap along one edge being stitched approximately along the back edge of the formed shoe pocket, and said flap disposed for extending forwardly and capable of folding over into contiguity overlying upon the formed shoe pocket, and providing at least its slot and zipper means with coverage, whereby upon opening of the cover flap and the zipper means the identified type of items may be inserted therein for safe keeping.

3. The invention of claim 2 and wherein said cover flap likewise extends from the eyestay to the sole shank of the quarter portion for the athletic shoe.

4. The invention of claim 3 and including fastening means provided upon both the cover flap and the pocket and cooperating to hold the flap against said pocket during shoe usage, said fastening means comprising a hook and pile type of fastening means.

* * * * *